US012490784B2

(12) United States Patent
Rusakov et al.

(10) Patent No.: US 12,490,784 B2
(45) Date of Patent: Dec. 9, 2025

(54) CATCHER'S CHEST PROTECTOR WITH GRIP ELEMENTS FOR IMPROVED BALL CONTROL

(71) Applicant: EASTON DIAMOND SPORTS, LLC, Thousand Oaks, CA (US)

(72) Inventors: Dmitry Rusakov, Montreal (CA); Allan Wong, Hong Kong (HK)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 1300 days.

(21) Appl. No.: 15/954,515

(22) Filed: Apr. 16, 2018

(65) Prior Publication Data

US 2019/0313712 A1 Oct. 17, 2019

(51) Int. Cl.

| | |
|---|---|
| ***A41D 13/015*** | (2006.01) |
| ***A41D 13/05*** | (2006.01) |
| ***A63B 71/12*** | (2006.01) |
| ***A63B 102/18*** | (2015.01) |

(52) U.S. Cl.

CPC ..... *A41D 13/0156* (2013.01); *A41D 13/0518* (2013.01); *A63B 71/12* (2013.01); *A41D 2400/80* (2013.01); *A41D 2600/10* (2013.01); *A63B 2071/1208* (2013.01);

(Continued)

(58) Field of Classification Search

CPC ..... A41D 13/0156; A41D 13/0518; A41D 2400/10; A41D 19/01547; A41D 2600/10; A41D 2400/80; A41D 13/0568; A41B 11/008; A63B 2071/1208; A63B 2209/10;

(Continued)

(56) References Cited

U.S. PATENT DOCUMENTS 1,670,239 A * 5/1928 Cline ..... A41D 13/0156 2/463
3,574,861 A 4/1971 Hale
4,183,097 A 1/1980 Mellian (Continued)

FOREIGN PATENT DOCUMENTS

CA 2878388 * 7/2012 ..... A41B 11/00
CA 2878388 A1 * 1/2014 ..... A41B 11/00

(Continued)

OTHER PUBLICATIONS

Dimock, Gabe, "Blocking Technique: Should Catchers Move Forward When They Block?," Baseball Rebellion, available at https://baseballrebellion.com/gabedimock/blocking-technique-should-catchers-move-forward-when-they-block/, posted Nov. 10, 2016; website visited Sep. 16, 2018.

(Continued)

*Primary Examiner* — Haley A Smith
(74) *Attorney, Agent, or Firm* — PERKINS COIE LLP

(57) ABSTRACT

A chest protector may include a flexible panel configured to generally conform to a user's chest and abdominal regions, one or more retention elements connected to the flexible panel and positioned to hold the chest protector on the user, and one or more high-friction elements positioned on an anterior outer surface of the flexible panel, the one or more high-friction elements configured to reduce angular momentum, or change rotation, of a ball impacting at least one of the one or more high-friction elements. The high-friction elements may include elements of tacky material, such as one or more dots or other elements of tacky material.

26 Claims, 3 Drawing Sheets

(52) U.S. Cl.
CPC ..... *A63B 2102/18* (2015.10); *A63B 2102/182* (2015.10); *A63B 2209/00* (2013.01); *A63B 2209/10* (2013.01)

(58) Field of Classification Search
CPC ..... A63B 2102/18; A63B 2102/182; A63B 71/12; A63B 2071/1203; A63B 2209/00
USPC ..... 2/45, 44, 463
See application file for complete search history.

(56) References Cited

U.S. PATENT DOCUMENTS 4,272,847 A 6/1981 Buhler
4,516,273 A 5/1985 Gregory et al.
4,525,875 A 7/1985 Tomczak
4,590,621 A 5/1986 Flosi et al.
4,660,223 A 4/1987 Fritch
4,694,505 A 9/1987 Flosi et al.
4,847,913 A 7/1989 Chen
4,868,926 A 9/1989 Lowson
4,989,265 A 2/1991 Nipper et al.
4,993,076 A 2/1991 Dierickx
5,020,156 A 6/1991 Neuhalfen et al.
5,020,547 A 6/1991 Strock
5,093,931 A 3/1992 Laberge et al.
5,173,964 A 12/1992 Ball et al.
5,325,537 A 7/1994 Marion
5,623,729 A 4/1997 Chen
5,933,874 A 8/1999 Randolph
6,038,701 A * 3/2000 Regan ..... A41D 13/088 2/125
6,161,226 A 12/2000 Serewicz et al.
6,182,299 B1 2/2001 Chen
6,233,737 B1 5/2001 Ditchfield et al.
6,302,490 B1 10/2001 Hanna et al.
6,336,458 B1 1/2002 Nafziger
6,519,782 B2 2/2003 Collins et al.
6,678,899 B2 1/2004 Fiorini et al.
6,738,984 B2 5/2004 Gillen et al.
6,775,851 B1 * 8/2004 Chen ..... A41D 13/0156 2/463
6,789,274 B1 9/2004 Karpati
6,826,786 B2 12/2004 Fiorini
6,880,172 B2 4/2005 Quintero
7,065,800 B2 6/2006 Brown
7,181,772 B2 2/2007 Gillen et al.
7,346,935 B1 * 3/2008 Patterson ..... A41B 11/004 2/239
7,823,218 B2 11/2010 Goyer et al.
7,900,283 B1 3/2011 Chen
7,941,867 B2 5/2011 Olson
8,024,820 B2 9/2011 Weimer et al.
8,336,112 B2 12/2012 Weber et al.
8,353,067 B2 1/2013 Chen et al.
8,621,674 B2 1/2014 Perreault et al.
8,869,316 B2 10/2014 Lewis
9,174,111 B2 11/2015 Smith et al.
9,440,136 B2 9/2016 Smith
9,616,315 B2 4/2017 Smith
10,001,246 B2 6/2018 Sitzmann
10,052,546 B2 8/2018 Kucera et al.
10,145,507 B2 12/2018 Swan et al.
2002/0162162 A1 11/2002 Collins et al.
2003/0024035 A1 2/2003 Fiorini et al.
2003/0046752 A1 3/2003 Baumann
2003/0079271 A1 5/2003 Gillen et al.
2004/0003456 A1 * 1/2004 Nishimoto ..... A63B 71/12 2/463
2004/0143881 A1 7/2004 Fiorini et al.
2004/0199983 A1 10/2004 Gillen et al.
2005/0241052 A1 11/2005 Brown
2005/0251901 A1 11/2005 Link
2006/0005306 A1 * 1/2006 Call ..... A41D 13/0518 2/463
2006/0048292 A1 3/2006 Gillen et al.
2006/0080762 A1 4/2006 Kobren et al.
2006/0107433 A1 5/2006 Olson
2006/0277669 A1 12/2006 Mott
2007/0136935 A1 6/2007 Purington
2007/0204379 A1 * 9/2007 Bedard ..... A41F 19/00 2/128
2008/0216219 A1 9/2008 Desnoyers
2008/0235855 A1 10/2008 Kobren et al.
2008/0295216 A1 * 12/2008 Nordstrom ..... A41D 31/185 2/69
2009/0211001 A1 * 8/2009 Weimer ..... A63B 71/12 2/463
2010/0132099 A1 6/2010 Green et al.
2010/0205724 A1 8/2010 Kamradt
2010/0229278 A1 * 9/2010 Bates ..... A41D 13/0002 2/115
2010/0299806 A1 * 12/2010 Benini ..... A41D 13/0151 2/115
2011/0083246 A1 * 4/2011 Vitarana ..... A41D 27/28 2/69
2011/0131713 A1 6/2011 Darosa et al.
2011/0167546 A1 7/2011 Olson
2011/0167548 A1 7/2011 Jourde et al.
2011/0185464 A1 8/2011 Weber et al.
2011/0219524 A1 9/2011 Perreault et al.
2011/0307999 A1 12/2011 Jourde et al.
2012/0174282 A1 * 7/2012 Newton ..... A41D 13/0015 2/69
2012/0311774 A1 12/2012 Chen et al.
2013/0000024 A1 * 1/2013 Perreault ..... A41D 13/0568 2/463
2014/0007330 A1 1/2014 Smith et al.
2014/0026285 A1 * 1/2014 Baldino ..... A41D 13/0015 2/69
2014/0150154 A1 6/2014 Aquino
2014/0223630 A1 * 8/2014 Johnson ..... A41D 31/18 2/69
2014/0359912 A1 12/2014 Sutton
2015/0082507 A1 3/2015 Howland et al.
2015/0237924 A1 8/2015 Cosio
2016/0302496 A1 10/2016 Ferrara
2016/0346663 A1 12/2016 Kucera et al.
2017/0143054 A1 5/2017 Yoon et al.
2017/0160058 A1 * 6/2017 Limpisvasti ..... A41D 13/0562
2017/0311659 A1 11/2017 Guidetti
2018/0049484 A1 2/2018 Markison
2018/0099206 A1 4/2018 Staub et al.
2018/0160747 A1 * 6/2018 Epperson ..... A41D 31/12
2018/0242657 A1 * 8/2018 Hawkins ..... A41D 13/0156
2018/0325189 A1 * 11/2018 Stallbaum ..... A41D 1/08
2019/0037936 A1 2/2019 Schmidt et al.
2019/0183267 A1 6/2019 Pham
2019/0313712 A1 10/2019 Rusakov et al.
2019/0357605 A1 11/2019 Homan
2020/0037680 A1 2/2020 Person et al.
2020/0205491 A1 7/2020 Melofchik

FOREIGN PATENT DOCUMENTS

EP 2515067 A1 10/2012
JP 2005194677 A 7/2005

OTHER PUBLICATIONS

Easton Lacrosse, "Easton Stealth Goalie Lacrosse Chest Protector," http://www.lacrossegearreview.com/easton, exact publication date unknown, available at least as early as Apr. 29, 2016.
Wilson Sporting Goods, "Promotion Fastpitch Chest Protector," http://www.wilson.com/enus/fastpitch/protective-gear/catcher/promotion-fastpitch-chest-protector, exact publication date unknown, available at least as early as Apr. 29, 2016.
Falco, K., "Mandalorian Mercs Costume Club", [online]. Jul. 28, 2015 [retrieved on Jul. 5, 2017], Retrieved from the Internet: <URL:http://mandalorianmercs.org/forum/index.php?topic=74545.0>.
USPTO, Non-Final Office Action dated Nov. 15, 2017 for U.S. Appl. No. 15/143,330, 29 pgs.

(56) References Cited

OTHER PUBLICATIONS

USPTO, "International Search Report and Written Opinion", for PCT/US17/29473, Aug. 14, 2017, 8 pgs.

* cited by examiner

CATCHER'S CHEST PROTECTOR WITH GRIP ELEMENTS FOR IMPROVED BALL CONTROL

BACKGROUND

In baseball or softball, a catcher generally tries to catch a pitched ball from a position behind the batting plate (home plate). Sometimes a catcher may not be in a position to catch a ball, so he or she may need to use a technique called "blocking." Blocking a ball typically involves a catcher getting into a position to try to stop the ball from passing between his or her legs or passing around the catcher altogether, by using the catcher's mitt and the catcher's upper body. In many instances, when a player blocks the ball, it bounces up from the ground or the mitt to hit the player's chest or chest protector, which may cause it to deflect away from the catcher. A catcher's goal is to keep the ball as close to the body as possible to trap it and to enable him or her to quickly gain control of the ball to avoid giving the opponent time to advance to the next base.

SUMMARY

Representative embodiments of the present technology include a chest protector with a flexible panel configured to generally conform to a user's chest and abdominal regions, one or more retention elements connected to the flexible panel and positioned to hold the chest protector on the user, and one or more high-friction elements positioned on an anterior outer surface of the flexible panel, the one or more high-friction elements configured to reduce angular momentum of a ball impacting at least one of the one or more high-friction elements. In some embodiments, the flexible panel includes a plurality of padded sections.

The high-friction elements may include a plurality of high-friction elements distributed among or on two or more of the plurality of padded sections. The high-friction elements may be positioned to coextend with one or more of the plurality of padded sections positioned to cover, or corresponding to, a user's abdominal region. In some embodiments, the high-friction elements include a plurality of dots of tacky material, which may include silicone. The plurality of dots may include dots with overall widths between 2.3 millimeters and 4.5 millimeters. In some embodiments, one or more dots positioned closer to a first end of the chest protector (such as a top end when worn by a user) have first overall widths, and one or more dots positioned closer to a second end of the chest protector opposite the first end of the chest protector (such as a bottom end when worn by a user) have second overall widths that are greater than the first overall widths.

In another representative embodiment of the present technology, a chest protector includes an anterior surface positioned to face away from a user when the user dons the chest protector, a posterior surface positioned opposite the anterior surface and facing the user, a cushion material positioned between the anterior surface and the posterior surface, and one or more high-friction elements positioned on the anterior surface, the one or more high-friction elements coextending with at least part of an abdominal region of the chest protector. The high-friction elements may include a pattern of high-friction elements, the pattern comprising two elongated upper pattern portions extending from a lower pattern portion.

In another representative embodiment of the present technology, a chest protector includes an anterior surface positioned to face away from a user when the user dons the chest protector, a posterior surface positioned opposite the anterior surface and facing the user, a cushion material positioned between the anterior surface and the posterior surface, and means for changing rotation of a ball upon impact of the ball against the anterior surface. In some embodiments, the means for changing rotation may include a means for reducing or reversing a rotation rate of the ball. The means for changing rotation of a ball may include a plurality of elements of tacky material (such as silicone) positioned on the anterior surface.

The high-friction elements reduce or reverse rotation of a ball impacting the chest protector. An advantage of the present technology manifests in the ball traveling a shorter distance after impacting the chest protector 100, thus allowing the catcher to keep the ball close and quickly gain control of the ball.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to a catcher's chest protector with one or more grip elements for improved ball control, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to catchers' chest protectors (including straps, padding, or connectors, for example) may not be shown or described in detail so as to avoid unnecessarily obscuring the relevant description of the various embodiments. Accordingly, embodiments of the present technology may include additional elements or exclude some of the elements described below with reference to FIGS. 1-3, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball, but the technology may be used in other activities and it is not limited to use with balls or use in sports.

Figure 1:
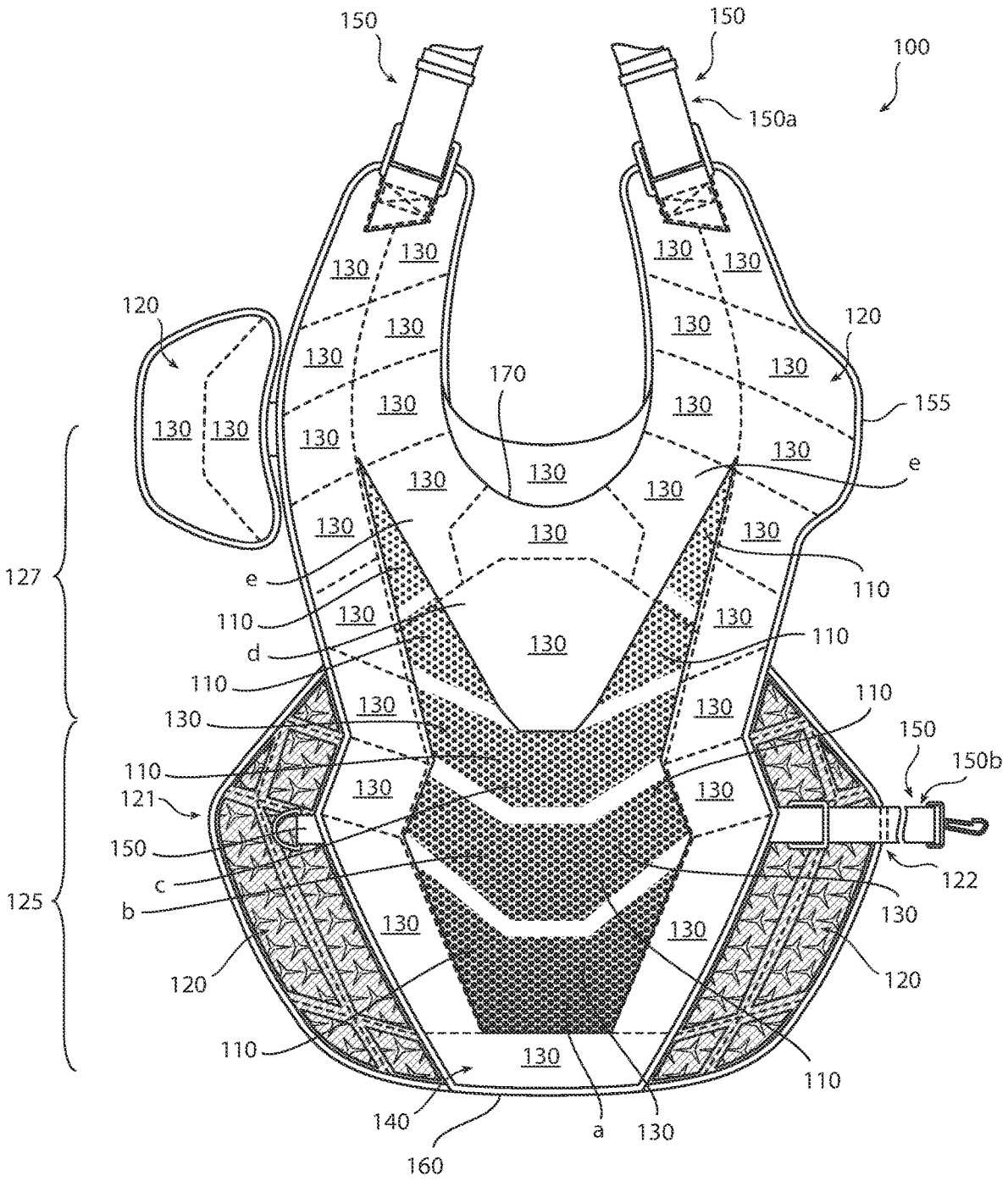
FIG. 1 illustrates a front view of a catcher's chest protector with one or more high-friction elements according to an embodiment of the present technology.

FIG. 1 illustrates a front view of a catcher's chest protector 100 with one or more high-friction elements (which may also be called grip elements) 110 according to an embodiment of the present technology. As described in additional detail below, the high-friction elements 110 reduce or reverse rotation of a ball that impacts the chest protector 100.

The chest protector 100 may include one or more flexible panels 120 configured to generally conform to a user's front torso region, such as a user's chest or abdominal region. For example, an abdominal region 125 of a flexible panel 120 of the chest protector 100 may generally conform with a user's abdominal region, while a chest or shoulder region 127 may generally confirm with a user's chest region and at least part of a user's shoulder region. FIG. 1 also shows a first free lateral end 121 of one of the flexible panels 120 and a second free lateral end 122 of another of the flexible panels 120. The free lateral ends 121, 122 extend laterally away from one another.

The flexible panels 120 may include padding or padded sections to absorb energy when a ball impacts the chest protector 100. For example, the flexible panels 120 may include one or more padded sections 130 that are capable of articulating or flexing relative to each other.

The padded sections 130 may be integral with each other or separate and attached to each other. The padded sections 130 may include a cushion material inside or on an outer surface of the padded sections 130. For example, a cushion material may be positioned between an anterior surface 140 of the chest protector 100 (facing away from the user when the user dons the chest protector 100) and a posterior or user-facing surface opposite the anterior surface 140. The chest protector 100 may further include retention elements 150, such as straps, buckles, or other fasteners for holding the chest protector 100 on the user. For example, the chest protector 100 may include a first strap 150*a* originating at a top portion of the chest protector 100 and extending away from the chest protector 100 along a first direction, and a second strap 150*b* originating below the first strap 150*a* when the user dons the chest protector 100, the second strap 150*b* extending away from the chest protector 100 along a second direction that is transverse to the first direction. In some embodiments, a peripheral edge 155 of the chest protector 100 (e.g., a peripheral edge of the anterior surface) can have an hourglass shape (e.g. narrower in a middle portion than in the upper and lower portions), as generally shown in FIG. 1.

Various suitable shapes and arrangements of flexible panels, padded sections, and retention elements are known in the art and can be used with the present technology. Accordingly, high-friction elements 110 according to embodiments of the present technology may be implemented on any suitable catcher's chest protector.

In some embodiments of the present technology, the high-friction elements 110 may be in the form of dots distributed on the anterior surface 140 of the chest protector 100. The dots may be circles, squares, ovals, triangles, or other suitable shapes. The dots may have any suitable size. In some embodiments, the dots may have an overall width or diameter between approximately 2.3 millimeters and 4.5 millimeters. In some embodiments, the dots may project outwardly from the anterior surface 140, while in other embodiments, the dots may be flush or approximately flush with the anterior surface 140. The dots or elements may all be the same size or they may have different sizes from one another.

In some embodiments, the dots or high-friction elements 110 may be distributed and positioned to coextend with one or more of the plurality of padded sections 130. For example, in a particular embodiment, padded abdominal sections a, b, and c may generally correspond with a portion of the chest protector 100 that covers a user's abdominal region (such as the abdominal region 125 of the chest protector 100). The padded abdominal sections a, b, and c may be partially or completely covered with a distribution or pattern of one or more high-friction elements 110.

Padded chest or shoulder sections d and e may generally correspond with a portion of the chest protector 100 that covers at least part of a user's chest or shoulder region (such as the chest or shoulder region 127 of the chest protector 100). The padded chest or shoulder sections d and e may be partially or completely covered with a distribution or pattern of one or more high-friction elements 110. As illustrated in FIG. 1, the padded chest or shoulder sections d and e are only partially covered with a distribution or pattern of high-friction elements 110, although they may be completely covered with a distribution or pattern of high-friction elements 110 in some embodiments. While only certain padded sections a, b, c, d, and e are illustrated as having high-friction elements 110, in some embodiments, more or fewer padded sections 130, or different arrangements of padded sections 130, may have high-friction elements 110 on their anterior surfaces 140.

The dots or other high-friction elements 110 may be made of a tacky or grippy material or composition of materials. In some embodiments, suitable materials may include any material with a coefficient of friction relatively higher than materials used elsewhere on the anterior surface 140 of the chest protector 100. For example, in some embodiments, the tacky or grippy material may comprise silicone, polyurethane, thermoplastic polyurethane, or other suitable tacky or grippy materials. The tacky or grippy material may be applied to the anterior surface 140 of the chest protector 100 by any suitable process, such as screen printing, gluing, tacking, or other methods. In some embodiments, the tacky or grippy material may include additives such as colored ink or silicone diluting agents.

In some embodiments, positions of one or more of the high-friction elements 110 (such as dots or other shapes) include one or more positions on the chest protector 100 where a ball may impact the chest protector 100 during play, such as during a blocking maneuver by a catcher. Accordingly, shapes and positions of high-friction elements 110 are not limited to the shapes and positions described and illustrated herein. In general, high-friction elements according to the present technology may coextend with all or part of an abdominal region 125 of the chest protector, all or part of a chest or shoulder region 127 of the chest protector, all of the anterior surface 140 of the chest protector 100, or other parts or portions of the chest protector 100. In various embodiments of the present technology, the high-friction elements 110 may coextend with any one or more of the padded sections 130.

In some embodiments, a higher density of high-friction elements 110 (such as a higher quantity of high-friction elements, a closer spacing between high-friction elements, or larger high-friction elements) in particular areas of the chest protector 100, relative to other areas, may be desirable. For example, a higher density of high-friction elements 110 may be implemented in areas more likely to be hit by a ball, while a lower density of high-friction elements 110 may be implemented in areas less likely to be hit by a ball. In a particular example, one or more high-friction elements 110 (such as dots) positioned closer to a lower end 160 of the chest protector 100 (when worn by a user) may be wider or larger than one or more high-friction elements 110 (such as dots) positioned closer to an upper end 170 of the chest protector 100 opposite the lower end 160. Accordingly, in some embodiments, there may be more high-friction, tacky, or grippy material closer to the lower end 160 than to the upper end 170. When a player is in a crouched position, he or she may block the ball using his or her abdominal area, so in some embodiments, there may be more high-friction, tacky, or grippy material in the abdominal region 125 of the chest protector 100 than in other areas or regions of the chest protector 100.

Figure 2:
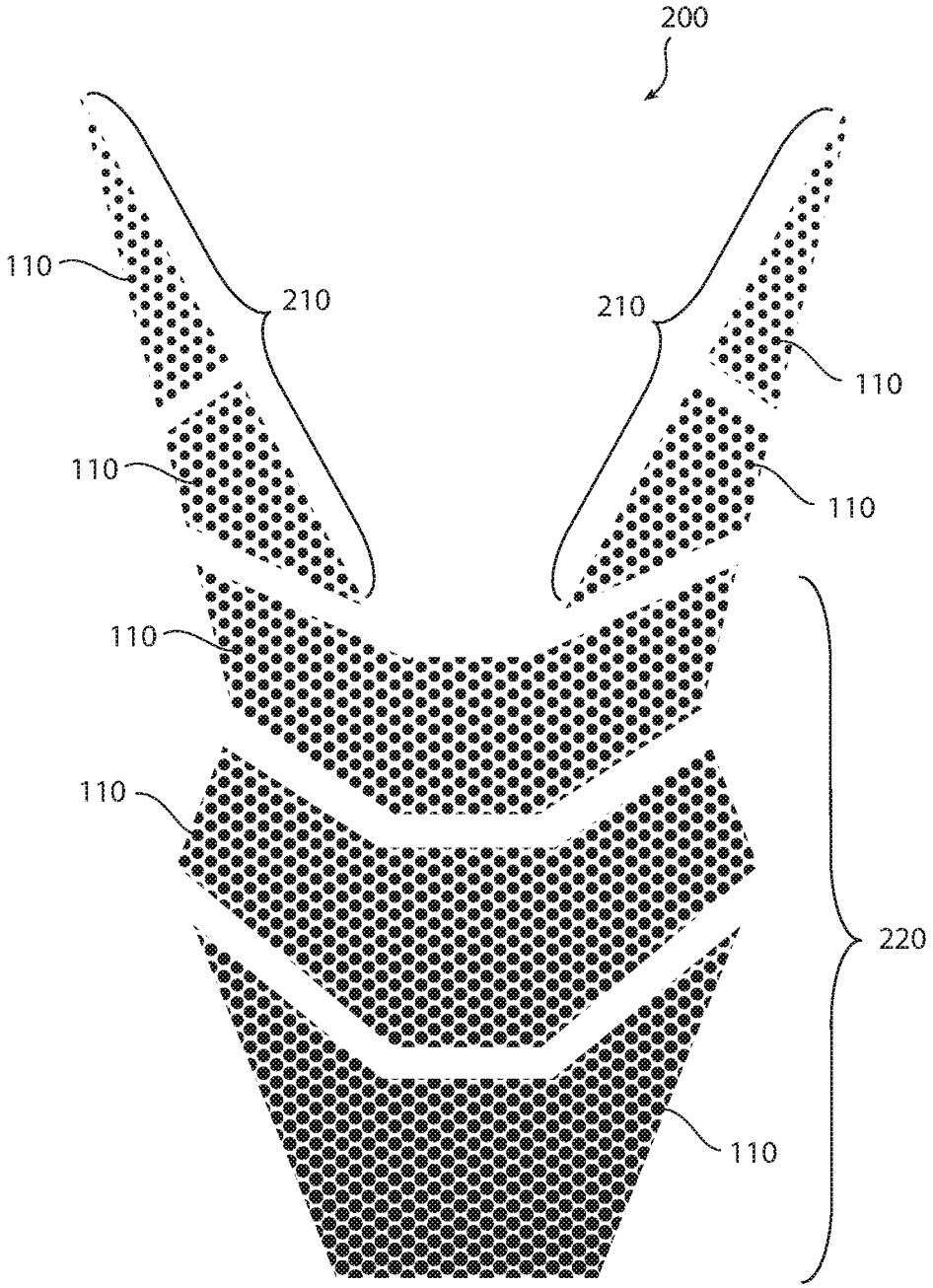
FIG. 2 illustrates a pattern of high-friction elements according to an embodiment of the present technology.

FIG. 2 illustrates a pattern 200 of high-friction elements 110 corresponding to the arrangement of high-friction elements 110 illustrated in FIG. 1. In some embodiments, the pattern 200 may be screen-printed onto a chest protector 100 (see FIG. 1). In some embodiments, the pattern 200 may include a plurality of elongated upper groups or portions 210 extending from, and optionally spaced from, a lower group or portion 220. Such a pattern may resemble a vest-shape to provide grip elements to the anterior surface of the chest protector in common areas where a ball may impact the chest protector.

Figure 3:
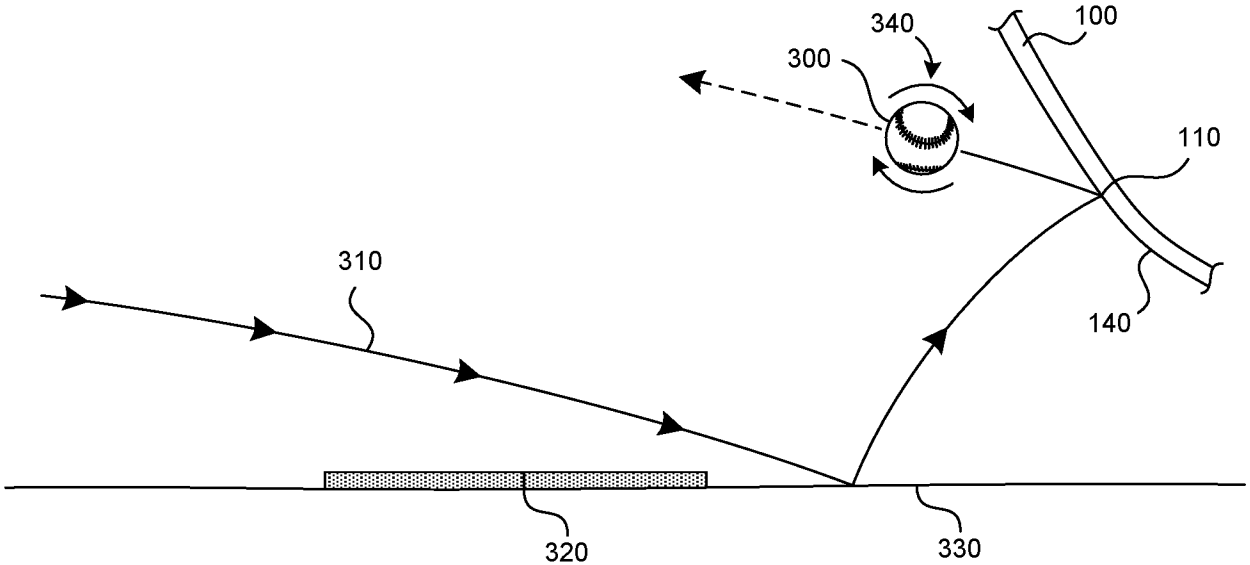
FIG. 3 illustrates a trajectory and rotation of a ball during a blocking maneuver, in which the ball impacts a catcher's chest protector according to an embodiment of the present technology.

FIG. 3 illustrates an example trajectory and rotation of a ball 300 during a blocking maneuver. An incoming pitch may follow a trajectory 310, in which the ball 300 passes over home plate 320 before hitting the ground 330 (or a catcher's mitt), bouncing up to the chest protector 100, and then bouncing off the chest protector 100 away from the catcher.

In embodiments of the present technology, high-friction elements 110 on the chest protector 100 grip or grab the surface of the ball 300 to reduce or reverse rotation of the ball 300. For example, as illustrated in FIG. 3, after impact with the chest protector 100 (specifically, with one or more high-friction elements 110), the ball may have a rotation 340 that tends to bring the ball back toward the catcher, or the rotation 340 may at least reduce the distance the ball travels away from the catcher after impact with the chest protector 100. Accordingly, embodiments of the present technology provide means for changing (such as reducing or reversing) rotation of a ball upon impact of the ball 300 against the anterior surface 140 of the chest protector 100. The high-friction elements reduce angular momentum of a spinning ball when it impacts the one or more high-friction elements.

An advantage of the present technology manifests in the ball traveling a shorter distance after impacting the chest protector 100, thus allowing the catcher to keep the ball close and quickly gain control of the ball.

In another embodiment of the present technology, a method of making a chest protector may include printing a plurality of high-friction elements (such as the high-friction elements 110 described above) on an anterior surface of the chest protector. The high friction elements may be printed in a pattern that coextends with at least part of the abdominal region 125 of the anterior surface 140 and at least part of a chest or shoulder region 127 of the anterior surface 140 (see FIG. 1). The method may include screen-printing the high-friction elements (such as by silk-screening on a hot plate), injection molding or casting the high-friction elements onto the chest protector (or creating the high-friction elements before attaching them to the chest protector), applying the high-friction elements using a drip molding process, or other suitable techniques for creating and adding the high-friction elements to the anterior surface 140 of the chest protector 100.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in some embodiments, the technology may be used with any shape or form of chest protector, including but not limited to the chest protector illustrated in FIG. 1. The pattern of high-friction elements may have any shape, distribution, position, pattern, or arrangement suitable for affecting rotation of a ball or other object impacting the chest protector. Accordingly, patterns of high-friction elements according to the present technology are not limited to the patterns illustrated in FIGS. 1 and 2.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A catcher's chest protector comprising:

a plurality of flexible panels collectively configured to generally conform to portions of a user's chest and abdominal regions, wherein the plurality of flexible panels comprises a first flexible panel laterally spaced apart from a second flexible panel, and wherein the first flexible panel comprises a free end extending laterally away from a free end of the second flexible panel;

one or more first straps connected to an upper portion of at least one flexible panel of the plurality of flexible panels and positionable to hold the catcher's chest protector on the user;

one or more second straps connected to the at least one flexible panel or to another at least one flexible panel of the plurality of flexible panels and positionable to hold the catcher's chest protector on the user, wherein the one or more second straps are connected to the at least one flexible panel or to the another at least one flexible panel toward a lower portion of the catcher's chest protector, and wherein the one or more second straps extend laterally; and one or more high-friction elements positioned on an anterior outer surface of at least one flexible panel of the plurality of flexible panels, the one or more high-friction elements configured to reduce angular momentum of a ball impacting at least one of the one or more high-friction elements.

2. The catcher's chest protector of claim 1 wherein the plurality of flexible panels comprises a plurality of padded sections.

3. The catcher's chest protector of claim 2 wherein the one or more high-friction elements comprise a plurality of high-friction elements distributed among two or more padded sections of the plurality of padded sections.

4. The catcher's chest protector of claim 2 wherein the one or more high-friction elements are positioned to coextend with one or more of the plurality of padded sections positioned to cover a user's abdominal region.

5. The catcher's chest protector of claim 1 wherein the one or more high-friction elements comprise a plurality of dots of tacky material.

6. The catcher's chest protector of claim 5 wherein the tacky material comprises silicone.

7. The catcher's chest protector of claim 5 wherein the plurality of dots comprises dots having overall widths between 2.3 millimeters and 4.5 millimeters.

8. The catcher's chest protector of claim 5 wherein one or more dots positioned closer to a first end of the catcher's chest protector have first overall widths, and one or more dots positioned closer to a second end of the catcher's chest protector opposite the first end of the catcher's chest protector have second overall widths that are greater than the first overall widths.

9. The catcher's chest protector of claim 8 wherein the second end of the catcher's chest protector is positioned below the first end of the catcher's chest protector when the catcher's chest protector is worn by a user.

10. The catcher's chest protector of claim 1, wherein at least one of the plurality of flexible panels is positioned at an upper side portion of the catcher's chest protector and configured to cover at least part of user's shoulder or upper arm region.

11. The catcher's chest protector of claim 1, wherein the at least one flexible panel with the one or more high-friction elements is positioned between the first flexible panel and the second flexible panel.

12. A catcher's chest protector comprising:

an anterior surface positioned to face away from a user when the user dons the catcher's chest protector;

a posterior surface positioned opposite the anterior surface;

a cushion material positioned between the anterior surface and the posterior surface;

at least one strap positioned to secure the catcher's chest protector to a user; and one or more high-friction elements positioned on the anterior surface, the one or more high-friction elements coextending with at least part of an abdominal region of the catcher's chest protector;

wherein:

the anterior surface comprises a first region positionable to cover at least a portion of a user's chest;

the anterior surface comprises a second region positionable to cover at least a portion of a user's abdomen, such that the first region is positioned longitudinally relative to the second region;

the first region extends along a first lateral distance;

the second region extends along a second lateral distance; and the second lateral distance is greater than the first lateral distance.

13. The catcher's chest protector of claim 12 wherein the one or more high-friction elements coextend with at least part of the first region.

14. The catcher's chest protector of claim 12 wherein the one or more high-friction elements comprise a plurality of elements of tacky material.

15. The catcher's chest protector of claim 14 wherein the tacky material comprises silicone.

16. The catcher's chest protector of claim 12 wherein the one or more high-friction elements comprises a plurality of high-friction elements, and wherein, when a user dons the catcher's chest protector, one or more of the high-friction elements positioned closer to a lower end of the catcher's chest protector than an upper end of the catcher's chest protector are larger than one or more of the high-friction elements positioned closer to the upper end than the lower end.

17. The catcher's chest protector of claim 12 wherein the one or more high-friction elements comprises a pattern of high-friction elements, the pattern comprising two elongated upper pattern portions extending from a lower pattern portion.

18. The catcher's chest protector of claim 12, wherein the at least one strap comprises a plurality of straps, and wherein a first strap of the plurality of straps is positioned above a second strap of the plurality of straps.

19. The catcher's chest protector of claim 12, wherein the first portion and the second portion each comprise free lateral ends.

20. A catcher's chest protector comprising:

an anterior surface positioned to face away from a user when the user dons the catcher's chest protector;

a posterior surface positioned opposite the anterior surface;

a cushion material positioned between the anterior surface and the posterior surface;

at least one strap positioned to secure the catcher's chest protector to a user; and means for changing rotation of a ball upon impact of the ball against the anterior surface;

wherein:

the anterior surface comprises a first free end and a second free end positioned laterally opposite the first free end, such that the anterior surface is not configured to wrap all the way around the user when the user dons the chest protector.

21. The catcher's chest protector of claim 20 wherein the means for changing rotation of a ball comprises a means for reducing or reversing a rotation rate of the ball.

22. The catcher's chest protector of claim 20 wherein the means for changing rotation of a ball comprises a plurality of elements of tacky material positioned on the anterior surface.

23. The catcher's chest protector of claim 22 wherein the tacky material comprises silicone.

24. The catcher's chest protector of claim 20 wherein the means for changing rotation of a ball comprises a first plurality of dots of tacky material positioned closer to a lower portion of the catcher's chest protector than to an upper portion of the catcher's chest protector, and a second plurality of dots of tacky material positioned closer to the upper portion than to the lower portion, wherein the first plurality of dots includes dots that are larger than dots in the second plurality of dots.

25. The catcher's chest protector of claim 20, wherein the at least one strap comprises two or more straps, and wherein:

a first strap of the two or more straps originates at a top portion of the chest protector and extends away from the chest protector along a first direction, and a second strap of the two or more straps originates below the first strap when the user dons the chest protector, and the second strap extends away from the chest protector along a second direction that is transverse to the first direction.

26. The catcher's chest protector of claim 20, wherein the anterior surface comprises an hourglass shape.

* * * * *